US007038097B2

(12) United States Patent
Molinier et al.

(10) Patent No.: US 7,038,097 B2
(45) Date of Patent: May 2, 2006

(54) DUAL BED PROCESS USING TWO DIFFERENT CATALYSTS FOR SELECTIVE HYDROGENATION OF ACETYLENE AND DIENES

(75) Inventors: Michel Molinier, Houston, TX (US); John Di-Yi Ou, Houston, TX (US); Michael A. Risch, Seabrook, TX (US); John Scott Buchanan, Lambertville, NJ (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 540 days.

(21) Appl. No.: 10/379,274

(22) Filed: Mar. 4, 2003

(65) Prior Publication Data

US 2004/0176652 A1 Sep. 9, 2004

(51) Int. Cl.

| | |
|---|---|
| ***C07C 5/05*** | (2006.01) |
| ***C07C 5/08*** | (2006.01) |
| ***C07C 5/09*** | (2006.01) |

(52) U.S. Cl. ..... 585/265; 585/258; 585/259; 585/261

(58) Field of Classification Search ..... 585/265, 585/258, 259, 261

See application file for complete search history.

(56) References Cited

U.S. PATENT DOCUMENTS

| | | | | |
|---|---|---|---|---|
| 3,580,837 | A | 5/1971 | Pollitzer | 208/57 |
| 3,689,401 | A | 9/1972 | Gomi et al. | 208/57 |
| 3,770,619 | A | 11/1973 | Derrien et al. | 208/255 |
| 3,969,221 | A | 7/1976 | Mitchell, III et al. | 208/139 |
| 4,013,548 | A | 3/1977 | Pollitzer et al. | 208/255 |
| 4,113,603 | A | 9/1978 | Bauer | 208/89 |
| 5,227,553 | A | 7/1993 | Polanek et al. | 585/259 |
| 5,817,901 | A | 10/1998 | Trambouze et al. | 585/259 |
| 2002/0004622 | A1 | 1/2002 | Dai et al. | 585/260 |
| 2002/0022754 | A1 | 2/2002 | Boyer et al. | 585/265 |
| 2002/0068843 | A1 | 6/2002 | Dai et al. | 585/260 |

FOREIGN PATENT DOCUMENTS

| | | |
|---|---|---|
| EP | 0541871 | 5/1993 |
| GB | 1432096 | 4/1976 |
| GB | 2131043 | 6/1984 |

OTHER PUBLICATIONS

McGown, et al., *Hydrogenation of Acetylene in Excess Ethylene on an Alumina-Supported Palladium Catalyst at Atmospheric Pressure in a Spinning Basket Reactor*, Journal of Catalysis 51, pp. 173-184 (1978).

Battison, et al., *Performance and Aging of Catalysts for the Selective Hydrogenation of Acetylene: A Micropilot-Plant Study, Applied Catalysis 2*, pp. 1-17 (1982).

LeViness, Stephen Claude. *Polymer formation, deactivation, and ethylene selectivity decline in Pd/A1203 catalyzed selective acetylene hydrogenation*, Rice University, pp. 211-259 (1989).

*Primary Examiner*—Thuan D. Dang
(74) *Attorney, Agent, or Firm*—Andrew B. Griffis

(57) ABSTRACT

It has been discovered that a dual bed process using two different catalysts for the selective hydrogenation of acetylene and/or methyl acetylene (MA) and/or propadiene (PD) in a light olefin-rich feedstream can be accomplished with less selectivity to making oligomers (green oil) as compared with existing commercial technologies, if a low oligomers selectivity catalyst is used first in the process. A palladium catalyst may be used as a second, sequential catalyst to further hydrogenate acetylene and/or MAPD while consuming at least a portion of the balance of the hydrogen present. The first catalyst should be different from the second catalyst.

41 Claims, 1 Drawing Sheet

DUAL BED PROCESS USING TWO DIFFERENT CATALYSTS FOR SELECTIVE HYDROGENATION OF ACETYLENE AND DIENES

FIELD OF THE INVENTION

The present invention relates to methods for selectively hydrogenating acetylene, methyl acetylene, propadiene, butadienes, and/or butynes in a light olefin-rich feedstream, and more particularly relates, in one embodiment, to methods for selective hydrogenation of acetylene and possibly other unsaturated compounds in an ethylene-rich feedstream with enhanced selectivity to olefins and reduced selectivity to the production of oligomers.

BACKGROUND OF THE INVENTION

Light olefin products (e.g. ethylene, propylene and butylenes) generated by various technologies such as gas to olefins, methanol to olefins, steam cracking or fluid catalytic cracking, contain highly unsaturated impurities, namely, acetylene, methyl acetylene (MA), propadiene (PD), and butadiene (BD) as by-products. Acetylene, MAPD, and BD must be removed from the light olefins because they are poisons to downstream olefin polymerization catalysts. Currently, selective hydrogenation of acetylene and/or MAPD and/or BD into the respective olefins is the most attractive technology option for olefin manufacturing plants. Traditionally, catalysts such as nickel or palladium supported on alumina have been used for the selective hydrogenation. Palladium-based catalysts, however, are becoming the workhorse of the industry by gradually replacing the older nickel-based catalysts.

The selective hydrogenation of acetylene and/or MAPD and/or BD is typically carried out in four unit types:

- Front-End Selective Catalytic Hydrogenation Reactors, where the feed is composed of C3 and lighter hydrocarbons, or C2 and lighter hydrocarbons. In the case of raw gas applications, other components such as butadiene, ethyl acetylene, dimethyl acetylene, vinyl acetylene, cyclopentadiene, benzene, and toluene can also be present.
- Back-End Selective Catalytic Hydrogenation Reactors, where the feed is composed of an ethylene-rich stream.
- MAPD Selective Catalytic Hydrogenation Reactors, where the feed is composed of a propylene-rich stream.
- BD Selective Catalytic Hydrogenation Reactors, where the feed is composed of a butylene-rich stream.

Current commercial acetylene, MAPD, and BD selective hydrogenation catalysts suffer from the problems of producing significant amounts of saturates (e.g. ethane, propane, butane) and green oil (C4+ oligomer compounds). The saturates come from over-hydrogenation of acetylene and/or MAPD and/or BD and/or the non-selective hydrogenation of ethylene and/or propylene and/or butene. Green oil is the result of oligomerization of acetylene, MAPD, BD and/or olefins. Both saturates and green-oil are undesirable owing to their adverse effect on ethylene-, propylene- or butene-gain selectivity. Green oil, however, is especially troublesome in that it also decreases catalyst life by depositing heavy compounds on catalyst surfaces.

It would be desirable to have a system and a process for the accurate and controlled hydrogenation of acetylene in an ethylene product stream for both economic and operational benefits including, but not necessarily limited to, provision of more consistent product quality, reduction in the amount of ethylene hydrogenated to ethane in the acetylene reactor, elimination of ethylene production loss due to acetylene reactor shut-down required by process upsets, extension of the life of catalysts by elimination of reactor runaways, and increase in run time between regeneration of catalyst by reduced formation of heavy hydrocarbon poisons, and reduction of overall hydrogen consumption.

SUMMARY OF THE INVENTION

Accordingly, it is an object of the present invention to provide a method in which acetylene and related compounds can be selectively hydrogenated in the presence of other unsaturated compounds.

It is another object of the present invention to provide a method for selectively hydrogenating acetylene and/or methyl acetylene and/or propadiene and/or butadiene in the presence of other unsaturated compounds that produces relatively fewer oligomers and saturates as compared with other methods using conventional palladium catalysts.

Still another object of the invention is to provide a method for the selective hydrogenation of acetylene and companion compounds in the presence of more desirable unsaturated compounds (e.g. ethylene) that maintains or improves the conversion of acetylene and/or minimizes the need for hydrogen.

In carrying out these and other objects of the invention, there is provided, in one form, a selective hydrogenation method involving first contacting in the presence of hydrogen a feedstock having at least one unsaturated compound that can be acetylene, methyl acetylene, propadiene, 1,2-butadiene, 1,3-butadiene, dimethyl acetylene, and ethyl acetylene and mixtures thereof with a low oligomers, low saturates selectivity first hydrogenation catalyst in a first reaction zone to produce a first product stream. Next, the first product stream is contacted in a second reaction zone, with optional additional hydrogen, where the second reaction zone is filled with a palladium-based and/or nickel-based second hydrogenation catalyst beginning from the end of the first reaction zone forward to produce a second product stream. In one non-limiting embodiment of the invention, the first hydrogenation catalyst in the first reaction zone is characterized by a selectivity to oligomers that is at least 30% lower than that of the second hydrogenation catalyst. Typically, the second hydrogenation catalyst in the second reaction zone is palladium-based and/or nickel-based.

In one embodiment of the invention, the first and the second reaction zones can be located in one reactor, wherein the first and the second hydrogenation catalysts are packed in a stacked-bed manner. In another embodiment of the invention, a reactor-in-series can be used, wherein the first and the second reaction zones can be located in a series of separate reactors. In yet another embodiment of the invention, the first reaction and the second reaction zones can employ a series of separate reactors wherein one of the reaction zones occupies at least one reactor and one of the reactors would be a stacked-bed reactor.

DEFINITIONS $C_2H_2$ Conversion:

$$\frac{(C_2H_2)_{in}-(C_2H_2)_{out}}{(C_2H_2)_{in}}\times 100$$

$C_2H_4$ Gain Selectivity:

$$\frac{(C_2H_2)_{in}-(C_2H_2)_{out}-C_2H_{6\ produced}-(2\times C_4+3\times C_6)_{produced}}{(C_2H_2)_{in}-(C_2H_2)_{out}}\times 100$$

$C_2H_6$ Selectivity:

$$\frac{C_2H_{6\ produced}}{(C_2H_2)_{in}-(C_2H_2)_{out}}\times 100$$

Green-Oil Selectivity:

$$\frac{(2\times C_4+3\times C_6)_{produced}}{(C_2H_2)_{in}-(C_2H_2)_{out}}\times 100$$

where:

$(C_2H_2)_{in}$=Concentration of $C_2H_2$ in feed, in mol %

$(C_2H_2)_{out}$=Concentration of $C_2H_2$ in product, in mol %

$(C_2H_6)_{produced}$=Difference in concentration of $C_2H_6$ between feed and product, in mol %

$(C_4+C_6)_{produced}$=Difference in concentration of $C_4$ and $C_6$ between feed and product, in mol %

Similar definitions can be used for MAPD and BD conversions and selectivities.

DETAILED DESCRIPTION OF THE INVENTION

The present invention relates to a novel catalytic process using two catalysts and two separated reaction zones that is capable of delivering selective hydrogenation performance with high ethylene- and/or propylene- and/or butene-gain selectivity and low selectivity to green oil (oligomers) and saturates. Additional benefits of the inventive process include, but are not necessarily limited to, the extension of the lifetimes of the catalysts and/or the extension of the operation cycle due to the reduction of green oil.

As used herein, the term "acetylene" includes the hydrocarbon $C_2H_2$ as well as other acetylenic hydrocarbons, such as methyl acetylene. The term "ethylene product stream" includes streams containing the hydrocarbon $C_2H_4$ as well as streams containing other mono- and diolefinically unsaturated hydrocarbons. It will be appreciated, however, that while the invention is often discussed in terms of selectively hydrogenating acetylene, MA, PD, or BD in a stream that is predominantly ethylene, propylene, or butylene, that the invention is not necessarily limited to the treatment of streams that contain ethylene, propylene, or butylene but is expected to find applicability to the selective hydrogenation of these compounds in streams of other chemical content as well.

Figure 1:
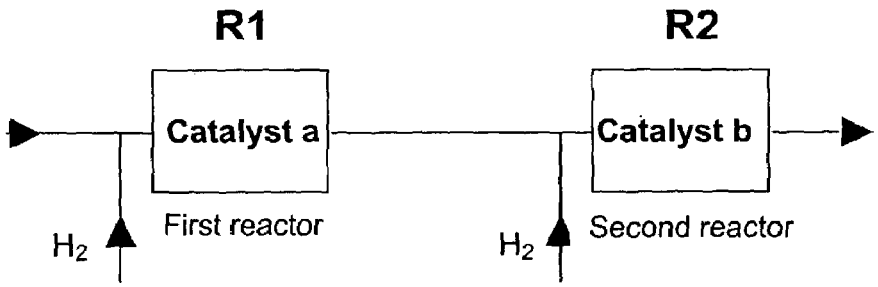
FIG. 1 is a schematic illustration of the dual bed selective hydrogenation process of the invention, where different catalysts are used in each reactor.

The discussion will initially focus on acetylene selective hydrogenation with reference to the process schematically illustrated in FIG. 1. However, it will be appreciated that the findings and observations could be applied to MAPD and BD selective hydrogenation as well.

The dual bed/dual catalyst process illustrated in FIG. 1 includes a catalyst in a first reaction zone R1, which converts at least 50% of the acetylene content of an ethylene-rich feedstream entering it. This catalyst is characterized by its low selectivity toward producing green oil and/or saturates. A second catalyst in second reaction zone R2 converts almost 100% of the acetylene content of the ethylene-rich first product stream exiting R1. This second catalyst is characterized by its high activity in acetylene selective hydrogenation.

In one non-limiting embodiment of the invention, and only for the purposes of illustration, the feedstream to the first reaction zone R1 may contain about 2% acetylene, about 70% ethylene, and the balance mostly ethane. (All percentages are mole % unless otherwise noted.) Such a stream is representative of a tail-end acetylene converter design. The first product stream from R1 to R2 in this non-limiting illustration would thus have less than 1% acetylene, about 70–71% ethylene and the balance mostly ethane.

In another non-limiting embodiment of the invention, and only for the purposes of illustration, the feedstream to the first reaction zone R1 may contain about 0.5% acetylene, about 30% ethylene, and the balance consisting of other compounds including ethane. Such a stream is representative of a front-end acetylene converter design. The first product stream from R1 to R2 in this non-limiting illustration would thus have less than 0.2% acetylene, more than about 30% ethylene and the balance other compounds including ethane. Depending upon the process configuration of the plant, this feed stream can also contain C3 components such as methyl acetylene, propadiene, propylene, and propane. Still heavier components such as 1,3 butadiene, 1,2 butadiene, ethyl acetylene, dimethyl acetylene, vinyl acetylene, cyclopentadiene, benzene, toluene may also be present as a result of certain process configurations.

In yet another one non-limiting embodiment of the invention, and only for the purposes of illustration, the feedstream to the first reaction zone R1 may contain at least 80% propylene, less than 10% methyl acetylene and propadiene, and the balance mostly propane. Such a stream is representative of a methyl acetylene-propadiene (MAPD) converter design. The first product stream from R1 to R2 in this non-limiting illustration would thus have less than 1% methyl acetylene and less than 1% propadiene, about 80–85% propylene and the balance mostly propane.

In still yet another non-limiting embodiment of the invention, and only for the purposes of illustration, the feedstream to the first reaction zone R1 may contain at least 90% butylene, greater than 0.2% butadiene, and the balance mostly butanes. Such a stream is representative of a butadiene (BD) converter design. The first product stream from R1 to R2 in this non-limiting illustration would thus have less than 1% butadiene, about 90–95% butylene and the balance mostly butane.

In one non-limiting embodiment of the invention, the first, hydrogenation catalyst, characterized by a selectivity to oligomers that is at least 30% lower than that of the second hydrogenation catalyst, may have two or more metals on a support. Since there is essentially no thermodynamic limitation to the hydrogenation reaction of acetylene to ethylene, the goal of greater than 50% ethylene selectivity is theoretically achievable. For the purpose of illustration only, one of the inventive catalyst systems may include:

1. A first constituent of at least one metal or metal-based component selected from the group of nickel and platinum. In one non-limiting embodiment of the invention, platinum is preferred.
2. A second constituent of at least one metal or metal-based component selected from the elements of Groups 1–10 of the Periodic Table of Elements (new IUPAC notation). In one non-limiting embodiment of the invention, preferred second constituents include, but are not necessarily limited to, metals from Groups 8, 9 of the Periodic Table of Elements (new IUPAC notation) and mixtures thereof.
3. A third constituent of at least one metal or metal-based component selected from the elements of Groups 11–12 of the Periodic Table of Elements (new IUPAC notation), where the fourth constituent is different from the second constituent. In one non-limiting embodiment of the invention, preferred fourth constituents include, but are not necessarily limited to, Zn, Ag or Au and mixtures thereof.
4. A fourth constituent of at least one support and/or binder selected from the group of amorphous inorganic oxides such as clay, alumina, silica, aluminophosphate, titania, magnesia, zirconia, etc., or crystalline inorganic oxides such as zeolites, molecular sieves, pinel, perovskite, etc., or any suitable inorganic solid material such as silicon carbide, silicon nitride, boron nitride, etc.
5. Optionally, a fifth constituent of at least one metal or metal-based component selected from the elements of Groups 13–15 of the Periodic Table of Elements (new IUPAC notation), where the fourth constituent is different from the second constituent. In one non-limiting embodiment of the invention, preferred fourth constituents include, but are not necessarily limited to, Ga, In, Sn or Bi and mixtures thereof.
6. Optionally, sulfur and/or oxygen.

The integrated results of these essential and optional constituents are a superior olefin selectivity, a lower saturate selectivity, and a lower green oil selectivity compared to the conventional Ni- or Pd-based catalysis. In one non-limiting embodiment of the invention, the first hydrogenation catalyst is a non-palladium catalyst.

The low oligomers selectivity catalyst that is used in the first reaction zone of this invention exhibits substantial activity in the selective hydrogenation of acetylene, on the order of 50 to 95% or more, with very low selectivity to oligomers (green oil) or saturates. Owing to its low green oil make, the catalyst of R1 is less prone to deactivation by coke formation than current palladium-based or nickel-based commercial formulations and thus provides extended durability. In one non-limiting embodiment of the invention, the oligomers selectivity of the catalyst used in the first reaction zone is at least 30% lower than the oligomers selectivity of the catalyst used in the second reaction zone. In another non-limiting embodiment of the invention, the oligomers selectivity of the catalyst used in the first reaction zone is preferably at least 50% lower than the oligomers selectivity of the catalyst used in the second reaction zone. In another non-limiting embodiment of the invention, the conversion of the unsaturated compound (acetylene, methyl acetylene, propadiene, 1,2-butadiene, 1,3-butadiene, dimethyl acetylene, ethyl acetylene and mixtures thereof by this first hydrogenation catalyst is at least 50%, preferably at least 90%.

The palladium-based and/or nickel-based catalyst of the second reaction zone R2 is used as a "clean-up" catalyst to complete the conversion of the acetylene remaining at the outlet of the first reaction zone R1. This catalyst, in one non-limiting embodiment, can be one of the existing commercial materials (i.e. Pd- or Pd/Ag-based) with high conversions approaching 100%, in one embodiment at least 90%, and high selectivity to green oil (typically on the order of 25% or more). Because a large portion (e.g. greater than 50%) of the acetylene has been removed in the first reaction zone R1, the acetylene partial pressure at the inlet of second reaction zone R2 has significantly dropped. Under lower acetylene concentrations, Pd-based catalysts produce less green oil. Indeed, the more acetylene that is removed from first reaction zone R1, the less green oil will be formed on the palladium-based catalyst in second reaction zone R2. Since less green oil results in less coke formation, the lifetime of the catalyst in second reaction zone R2 is substantially extended by the process.

It is difficult to precisely define the operating parameters of an alkyne/alkadiene selective hydrogenation process in advance due to a number of complex, interrelated factors including, but not necessarily limited to, the chemical composition of the feedstock, the control systems and design of a particular plant, etc (i.e. different reactor configurations including front-end, tail-end, MAPD, and BD converters as mentioned briefly above). Nevertheless, the following descriptions serve to give some sense of how the inventive process may be practiced.

In the case of a front-end (FE) selective hydrogenation process design, the inlet operating temperature in the first reaction zone R1 may range from about 30 to about 150° C., preferably from about 50 to about 100° C. Representative operating pressures may range from about 100 psig to about 500 psig, preferably from about 200 psig to about 400 psig. The GHSV may range from about 5000 to about 20,000, preferably from about 8000 to about 15,000, in non-limiting embodiments of the invention. Further, in other non-limiting embodiments of the invention, the $H_2$ partial pressure may range from about 25 psig to about 175 psig, preferably from about 50 psig to about 140 psig.

To give some sense of how the inventive process may be practiced with respect to the second reaction zone R2 in the case of a front-end (FE) selective hydrogenation reactor, the inlet operating temperature may range from about 30 to about 150° C., preferably from about 50 to about 100° C. Representative operating pressures may range from about 100 psig to about 500 psig, preferably from about 200 psig to about 400 psig. The GHSV may range from about 5000 to about 20,000, preferably from about 8000 to about 15000, in non-limiting embodiments of the invention. Further, in other non-limiting embodiments of the invention, the $H_2$ partial pressure may range from about 25 psig to about 175 psig, preferably from about 50 psig to about 140 psig.

In the case of a tail-end (TE) selective hydrogenation reactor, the inlet operating temperature in the first reaction zone R1 may range from about 30 to about 150° C., preferably from about 40 to about 90° C. Representative operating pressures may range from about 100 psig to about 500 psig, preferably from about 200 psig to about 400 psig. The GHSV may range from about 1000 to about 10,000, preferably from about 3000 to about 8000, in non-limiting embodiments of the invention. Further, in other non-limiting embodiments of the invention, the $H_2/C_2H_2$ molar feed ratio may range from about 0.5 to about 20, preferably from about 1.0 to about 1.5.

To give some sense of how the inventive process may be practiced with respect to the second reaction zone R2 in the case of a tail-end (TE) selective hydrogenation reactor, the inlet operating temperature may range from about 30 to about 150° C., preferably from about 40 to about 90° C. Representative operating pressures may range from about 100 psig to about 500 psig, preferably from about 200 psig to about 400 psig. The GHSV may range from about 1000 to about 10,000, preferably from about 3000 to about 8000, in non-limiting embodiments of the invention. Further, in other non-limiting embodiments of the invention, the $H_2/C_2H_2$ molar feed ratio may range from about 0.5 to about 20, preferably from about 1.0 to about 1.5.

In the case of a methyl acetylene/propadiene (MAPD) selective hydrogenation reactor, operation can be conducted in either the liquid or vapor phase. In the case of the liquid phase, the inlet operating temperature in the first reaction zone R1 may range from about 20 to about 100° C., preferably from about 30 to about 80° C. Representative operating pressures may range from about 150 psig to about 600 psig, preferably from about 250 psig to about 500 psig. The LHSV may range from about 0.1 to about 100, preferably from about 1 to about 10, in non-limiting embodiments of the invention. In the case of the vapor phase, the inlet operating temperature in the first reaction zone R1 may range from about 20 to about 600° C., preferably from about 200 to about 400° C. Representative operating pressures may range from about 150 psig to about 600 psig, preferably from about 250 psig to about 500 psig. The GHSV may range from about 100 to about 20,000, preferably from about 500 to about 5000, in non-limiting embodiments of the invention. Further, in other non-limiting embodiments of the invention, the $H_2/C_2H_2$ molar feed ratio may range from about 0.5 to about 20, preferably from about 1 to about 10.

To give some sense of how the inventive process may be practiced with respect to the second reaction zone R2 in the case of a liquid phase methyl acetylene/propadiene (MAPD) selective hydrogenation reactor, the inlet operating temperature in the first reaction zone R1 may range from about 20 to about 100° C., preferably from about 30 to about 80° C. Representative operating pressures may range from about 150 psig to about 600 psig, preferably from about 250 psig to about 500 psig. The LHSV may range from about 0.1 to about 100, preferably from about 1 to about 10, in non-limiting embodiments of the invention. To give some sense of how the inventive process may be practiced with respect to the second reaction zone R2 in the case of a vapor phase methyl acetylene/propadiene (MAPD) selective hydrogenation reactor, the inlet operating temperature in the may range from about 20 to about 600° C., preferably from about 200 to about 400° C. Representative operating pressures may range from about 150 psig to about 600 psig, preferably from about 250 psig to about 500 psig. The GHSV may range from about 100 to about 20,000, preferably from about 500 to about 5000, in non-limiting embodiments of the invention.

In the case of a butadiene (BD) selective hydrogenation reactor, operation can be conducted in either the liquid or vapor phase. In the case of the liquid phase, the inlet operating temperature in the first reaction zone R1 may range from about 20 to about 120° C., preferably from about 40 to about 100° C. Representative operating pressures may range from about 150 psig to about 600 psig, preferably from about 200 psig to about 400 psig. The LHSV may range from about 0.1 to about 100, preferably from about 1 to about 25, in non-limiting embodiments of the invention. In the case of the vapor phase, the inlet operating temperature in the first reaction zone R1 may range from about 20 to about 600° C., preferably from about 50 to about 200° C. Representative operating pressures may range from about 150 psig to about 600 psig, preferably from about 250 psig to about 500 psig. The GHSV may range from about 100 to about 20,000, preferably from about 500 to about 5000, in non-limiting embodiments of the invention. Further, in other non-limiting embodiments of the invention, the $H_2/C_2H_2$ molar feed ratio may range from about 0.5 to about 20, preferably from about 1 to about 10.

To give some sense of how the inventive process may be practiced with respect to the second reaction zone R2, in the case of the liquid phase, the inlet operating temperature in the first reaction zone R1 may range from about 20 to about 120° C., preferably from about 40 to about 100° C. Representative operating pressures may range from about 200 psig to about 600 psig, preferably from about 200 psig to about 400 psig. The LHSV may range from about 0.1 to about 100, preferably from about 1 to about 25, in non-limiting embodiments of the invention. To give some sense of how the inventive process may be practiced with respect to the second reaction zone R2 in the case of the vapor phase, the inlet operating temperature may range from about 20 to about 600° C., preferably from about 50 to about 200° C. Representative operating pressures may range from about 150 psig to about 600 psig, preferably from about 250 psig to about 500 psig. The GHSV may range from about 100 to about 20,000, preferably from about 500 to about 5000, in non-limiting embodiments of the invention. Further, in other non-limiting embodiments of the invention, the $H_2/C_2H_2$ molar feed ratio may range from about 0.5 to about 20, preferably from about 1 to about 10.

The process of the present invention offers at least the following advantages in addition to the advantages of activity and selectivity improvements:

a) In one of the non-limiting embodiment of the invention, the process allows the operation of two or more reactors or two or more beds or two or more zones, and thus operation of the two catalysts, at different temperatures.

b) The process allows the use of different parameters (temperature, pressure, gas composition) for the pre-conditioning of the two catalysts; furthermore, should pre-conditioning be required for one catalyst only, it allows pre-conditioning of one catalyst without affecting the other one.

c) The process allows different injection rates of hydrogen in the two catalyst beds during operation.

d) The process conveniently fits most existing facilities, since the selective hydrogenation of acetylene is typically performed with two catalyst beds in series, where both beds are filled with the same catalyst.

e) In another non-limiting embodiment of the invention, the process allows the operation of two catalysts stacked in one reactor, which offers additional flexibility for optimization of process performance.

The inventive process will now be further illustrated with respect to specific Examples that are intended only to further demonstrate the invention, but not limit it in any way.

EXAMPLE I

This Example illustrates the preparation of catalysts used in the present invention.

Catalyst A: 0.6% Pt, 2.4% Ru on $Al_2O_3$

Theta-alumina (4.77 g; SBa-90, available from Sasol Limited) was mixed with 20 ml de-ionized $H_2O$ and a slurry was obtained. Next, 0.06 g $H_2PtCl_6.H_2O$ was dissolved in 20 ml de-ionized $H_2O$. Then, 0.25 g $RuCl_3.xH_2O$ was dissolved in 40 ml de-ionized $H_2O$. The platinum solution was mixed with the ruthenium solution. The solution containing both metals was added to the alumina slurry. After 1 hour stirring, the slurry was gently heated until most of the water was removed. The resulting paste was dried in a vacuum oven for 2 hours. The remaining powder was calcined under air for 2 hours at 120° C. and 4 hours at 450° C.

Catalyst B: 0.03% Pd, 0.18% Ag on $Al_2O_3$

Theta-alumina (19.95 g; MI-407, available from W.R. Grace & Co.) was mixed with 50 ml de-ionized $H_2O$ and a slurry was obtained. Next, 0.01 g $Pd(NO_3)_2.xH_2O$ and 0.06 g $AgNO_3$ were dissolved in 30 ml de-ionized $H_2O$. The solution containing both metals was added to the alumina slurry. After 30 minutes stirring, the slurry was gently heated until most of the water was removed. The resulting paste was dried in a vacuum oven for 2 hours. The remaining powder was calcined under air for 2 hours at 120° C. and 4 hours at 550° C.

Catalyst C: 0.03% Pd, 0.36% Ag on $Al_2O_3$

Theta-alumina (19.92 g; MI-407, available from W.R. Grace & Co.) was mixed with 80 ml de-ionized $H_2O$ and a slurry was obtained. Next, 0.01 g $Pd(NO_3)_2.xH_2O$ and 0.11 g $AgNO_3$ were dissolved in 60 ml de-ionized $H_2O$. The solution containing both metals was added to the alumina slurry. After 30 minutes stirring, the slurry was gently heated until most of the water was removed. The resulting paste was dried in a vacuum oven for 2 hours. The remaining powder was calcined under air for 2 hours at 120° C. and 4 hours at 550° C.

Catalyst D: 0.03% Pd, 0.18% Ag on MgO

Magnesium oxide (19.95 g; available from Aldrich) was mixed with 60 ml de-ionized $H_2O$ and a slurry was obtained. Next, 0.01 g $Pd(NO_3)_2.xH_2O$ and 0.06 g $AgNO_3$ were dissolved in 60 ml de-ionized $H_2O$. The solution containing both metals was added to the slurry. After 30 minutes stirring, the slurry was gently heated until most of the water was removed. The resulting paste was dried in a vacuum oven for 2.5 hours. The remaining powder was calcined under air for 2 hours at 120° C. and 4 hours at 550° C.

Catalyst E: 0.6% Pt, 2.4% Ru, 1.2% Ag on $Al_2O_3$

Theta-alumina (38.17 g; SBa-90, available from Sasol Limited) was mixed with 150 ml de-ionized $H_2O$ and a slurry was obtained. Next, 0.50 g $H_2PtCl_6.H_2O$ was dissolved in 50 ml de-ionized $H_2O$. Then, 1.97 g $RuCl_3.xH_2O$ was dissolved in 250 ml de-ionized $H_2O$. The platinum solution was mixed with the ruthenium solution. The solution containing both metals was added to the alumina slurry. After 1 hour stirring, the slurry was gently heated until most of the water was removed. The resulting paste was dried in a vacuum oven for 2 hours. The remaining powder was calcined under air for 2 hours at 120° C. and 4 hours at 450° C. Next, 10.0 g of the obtained powder were mixed with 60 ml de-ionized $H_2O$ and a slurry was obtained. Following this, 0.19 g $AgNO_3$ was dissolved in 40 ml de-ionized $H_2O$. The silver slurry was added to the previous slurry. After 1 hour stirring, the slurry was gently heated until most of the water was removed. The resulting paste was dried in a vacuum oven for 2 hours. The remaining powder was calcined under air for 2 hours at 120° C. and 4 hours at 450° C.

Catalyst F: 1.2% Pt, 2.4% Ru, 1.2% Ga on $Al_2O_3$

Theta-alumina (19.07 g; SBa-90, available from Sasol Limited) was mixed with 80 ml de-ionized $H_2O$ and a slurry was obtained. Next, 0.50 g $H_2PtCl_6.H_2O$ was dissolved in 40 ml de-ionized $H_2O$. Then, 0.98 g $RuCl_3.xH_2O$ was dissolved in 160 ml de-ionized $H_2O$. The platinum solution was mixed with the ruthenium solution. The solution containing both metals was added to the alumina slurry. After 1 hour stirring, the slurry was gently heated until most of the water was removed. The resulting paste was dried in a vacuum oven for 2 hours. The remaining powder was calcined under air for 2 hours at 120° C. and 4 hours at 450° C. Next, 5.0 g of the obtained powder were mixed with 30 ml de-ionized $H_2O$ and a slurry was obtained. Following this, 0.22 g $Ga(NO_3)_3.xH_2O$ was dissolved in 30 ml de-ionized $H_2O$. The gallium solution was added to the slurry. After 1 hour stirring, the slurry was gently heated until most of the water was removed. The resulting paste was dried in a vacuum oven for 2 hours. The remaining powder was calcined under air for 2 hours at 120° C. and 4 hours at 450° C.

EXAMPLE II

This Example shows the performance of a bimetallic, low green oil make catalyst that could be used in the first reaction zone R1. The catalyst was evaluated under the following conditions: T(catalyst)=100° C., P=300 psig, GHSV=4500, $H_2/C_2H_2$ feed ratio=1.1. The hydrocarbon feed contained 1.65 mole % acetylene, 70 mole % ethylene, and balance nitrogen. Test results are given in Table 1 below.

TABLE 1

| Test # | Catalyst (Ref. #) | $C_2H_2$ conv. (%) | $C_2H_4$ sel. (%) | $C_2H_6$ sel. (%) | $H_2$ conv. (%) | GO sel. (%) |
|---|---|---|---|---|---|---|
| 1 | A | 55.8 | 28.4 | 61.1 | 100 | 10.5 |

Under the same conditions, the state-of-the-art Pd/Ag-based commercial catalyst G-58C, from Süd Chemie, Inc., gives about 2.5–3 times higher green oil selectivity; please see test #2 in Table 2, below.

Potential Pd-based catalysts for second reaction zone R2 are displayed in Table 2 below with their test results. They were evaluated under similar conditions to those used for first reaction zone R1, i.e. T(catalyst)=100° C., P=300 psig, GHSV=4500, $H_2/C_2H_2$ feed ratio=1.3. The hydrocarbon feed was 1.65 mole % acetylene, 70 mole % ethylene, and balance nitrogen. In this process, the actual inlet to second reaction zone R2 (outlet of first reaction zone R1) would carry less than half the acetylene contained in the inlet to reaction zone R1, which could potentially result in a significant drop in green oil make by Pd-based catalysts. Thus, the most important feature for the second reaction zone R2 catalyst is high acetylene conversion. Test results are given in Table 2 below.

TABLE 2

| Test # | Catalyst (Ref. #) | $C_2H_2$ conv. (%) | $C_2H_4$ sel. (%) | $C_2H_6$ sel. (%) | $H_2$ conv. (%) | GO sel. (%) |
|---|---|---|---|---|---|---|
| 2 | G58-C | 96.9 | 45 | 28.8 | 100 | 26.2 |
| 3 | B | 98.4 | 51.7 | 22.6 | 100 | 25.7 |
| 4 | C | 100 | 44.1 | 29.3 | 100 | 26.6 |
| 5 | D | 100 | 51.6 | 21.1 | 100 | 27.4 |

The idea that high activity catalysts would produce less green oil under lower acetylene partial pressure is supported by the following documents, all of which are incorporated by reference herein. S. C. LeViness in "Polymer Formation, Deactivation, and Ethylene Selectivity Decline in $Pd/Al_2O_3$ Catalyzed Selective Acetylene Hydrogenation," PhD Thesis, Rice University (1989), p. 243, notes that the rate of surface polymer production at 40° C., on a 0.1% Pd on 90 $m^2/g$ $Al_2O_3$ catalyst, was found to slowly decrease with acetylene partial pressure from 20 to 5 torr and then drop linearly below 5 torr. The feed rate was 2 ml/min hydrocarbon mixture (HC mixture: 7.74% $C_2H_2$, 0.03% $C_2°$, 13.18% $H_2$, balance $C_2H_4$), 14 ml/min He.

The percentage of $C_2H_2$ converted to $C_4$ was shown to decrease with $C_2H_2$ concentration when the latter value was below 2000 ppm, at four different $H_2$ concentrations (i.e. 2.6%, 9.4%, 22.8% and 37.5%), other parameters being kept constant. The same observation was done with 3 different gas compositions (namely 1000 ppm CO, 35% $C_2H_4$; 5000 ppm CO, no $C_2$=; 5000 ppm CO, 35% $C_2H_4$), other parameters being kept constant. The catalyst was ICI 38–3 (0.04% Pd on pellets of transitional alumina), temperature was 70° C., gas flow was 20 liter/hr. William T. McGown, et al., "Hydrogenation of Acetylene in Excess Ethylene on an Alumina-supported Palladium Catalyst at Atmospheric Pressure in a Spinning Basket Reactor," *Journal of Catalysis*, Vol. 51, (1978), p. 173.

With three different $C_2H_2$ contents in the feed of 0.01%, 0.5% and 1%, carbon content of spent catalysts were reported to be 0.24%, 4.5% and 7.7%, respectively. The runlength was 24 hours, 0.03% Pd on $Al_2O_3$ type catalyst; the temperature was 75° C., GHSV=4166–44257 $hr^{-1}$, 10 ppm CO, $H_2/C_2H_2$=1.5 except for the first test, where $H_2/C_2H_2$=1.84, balance $C_2H_4$. G. C. Battiston, et al., "Performance and Aging of Catalysts for the Selective Hydrogenation of Acetylene: A Micropilot-Plant Study," *Applied Catalysis*, Vol. 2, (1982) p. 1.

EXAMPLE III

This Example shows the performance of trimetallic, low green oil make catalysts that could be used in the first reaction zone R1. They were evaluated under the same conditions as the R1 bimetallic catalyst from Example II. They could be combined with any of the second reaction zone R2 catalysts depicted in Example II. The test results are given in Table 3 below.

TABLE 3

| Test # | Catalyst (Ref. #) | $C_2H_2$ conv. (%) | $C_2H_4$ sel. (%) | $C_2H_6$ sel. (%) | $H_2$ conv. (%) | GO sel. (%) |
|---|---|---|---|---|---|---|
| 6 | E | 56.3 | 44.2 | 46 | 87.2 | 9.9 |
| 7 | F | 52.5 | 18.5 | 71.6 | 100 | 9.8 |

Figure 2:
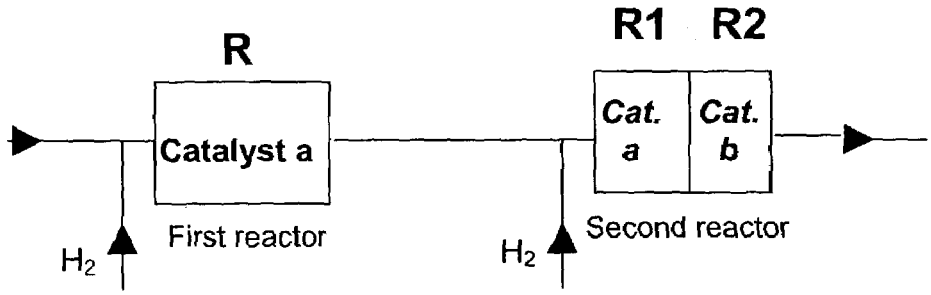
FIG. 2 is a schematic illustration of another embodiment of the dual bed selective hydrogenation process of the invention, where the front portion of a second reactor contains a portion of the same catalyst used in the first reactor, and the back portion of said second reactor contains a different catalyst.

Attention will now turn to selective acetylene hydrogenation with reference to the process schematically illustrated in FIG. 2. However, it will again be appreciated that the findings and observations could be applied to MAPD and BD selective hydrogenation as well. The embodiment described with respect to FIG. 2 would be particularly suited to retrofitting the method of the present invention into a plant already having two or more reactors of fixed size.

In one non-limiting embodiment of the invention, for the case of retrofitting a plant already having two reactors of fixed size, the first reactor can contain the first reaction zone and the second reactor can contain the second reaction zone. In another non-limiting embodiment of the invention, the first reactor and a fraction of the second reactor, beginning at the inlet of the second reactor, can contain the first reaction zone and the remaining fraction of the second reactor can contain the second reaction zone. In yet another non-limiting embodiment of the invention, a fraction of the first reactor, beginning at the inlet of the first reactor, can contain the first reaction zone and the remaining fraction of the first reactor and the entire second reactor can contain the second reaction zone.

As noted, due to downstream process requirements, e.g. ethylene polymerization, the selective hydrogenation of acetylene must be carried out at very high acetylene and hydrogen conversion levels. Typical target specifications for ethylene are less than 5 ppm hydrogen and less than 1 ppm acetylene.

In order to avoid hydrogen breakthrough from second reaction zone R2, the amount of hydrogen co-fed in a tail-end acetylene converter must be minimized. Furthermore, using commercial Pd-based catalysts, excess hydrogen co-feeding may result in reaction runaway, which would favor ethane production. On the other hand, reaction conditions where hydrogen is scarce result in a green oil production increase.

The process described in the present embodiment of the invention allows the use of a slight hydrogen feed excess, thereby minimizing green oil formation, while avoiding excessive loss of ethylene due to reaction runaway as well as avoiding hydrogen breakthrough.

The dual bed/dual catalyst embodiment illustrated in FIG. 2 includes:

1. A catalyst a in a first reactor, which converts 75% or more of the acetylene content of an ethylene-rich feedstream. This catalyst is characterized by a selectivity to oligomers that is at least 30% lower than that of the second hydrogenation catalyst, typically palladium-based and/or nickel-based, in the second reaction zone. This can be the same catalyst as used in zone R1 of the embodiment described with reference to FIG. 1, above.
2. The same catalyst a (or another catalyst a' with equivalent or higher activity relative to catalyst a) is present in the inlet portion of the second reactor, i.e. the second portion of reaction zone R1. Reaction zone R2 is occupied by a catalyst b, for instance one of the currently commercially available catalysts for tail-end converters described with respect to the catalysts useful in R2 of FIG. 1. This catalyst b is used as a clean-up catalyst for acetylene and hydrogen traces, in order to ensure that the overall system operates as close as possible to 100% acetylene and hydrogen conversion. Naturally, the higher the acetylene conversion provided by a (or a+a') will be, the smaller will be the reaction zone R2 occupied by b. If a (or a+a') converts 100% of the acetylene without converting 100% of the hydrogen, b can optionally be replaced by a hydrogen storage system that would require periodic regeneration.

Assuming most of the acetylene is converted over a and in the portion of the second reactor containing a (or a'), only traces of acetylene should reach reaction zone R2 occupied by b.

The hydrogen supplied between the two reactors should be co-fed in sufficient quantity to make sure that excess hydrogen reaches zone R2 containing catalyst a (or a') in order to lower green oil selectivity. The catalyst b will convert excess hydrogen by hydrogenating ethylene to ethane, but the ethylene loss should be small since reaction zone R2 occupied by b is small. Overall, such a system would provide ethylene selectivity equivalent to current Pd-based commercial catalysts, but the green oil selectivity would be reduced by half or more.

Table 4 below simulates the results that would be obtained on a feedstream containing 1% acetylene from two catalysts with the following theoretical performances. These catalysts descriptions are consistent with those already given above for R1 and R2 with respect to the FIG. 1 embodiment.

Catalyst a: 77% $C_2H_2$ conversion, 42% $C_2H_4$ selectivity, 46% $C_2H_6$ selectivity, 12% GO selectivity.

Catalyst b: 100% $C_2H_2$ conversion, 40% $C_2H_4$ selectivity, 40% $C_2H_6$ selectivity, 20% GO selectivity. The catalyst b, compared to current commercial operation, would be exposed to higher temperatures and equivalent or higher $H_2/C_2H_2$ ratio, as compared to that required for catalyst a. Thus, the green oil selectivity estimate of 20% seems reasonable.

In this simulation, reaction zone R2 occupied by b is assumed to be small enough to allow space velocities over a in R2 and R1 to be comparable, thus conversions and selectivities over a in R1 and R2 are kept the same.

Further in this simulation, $H_2/C_2H_2$ is 1.3 at the R1 inlet, $H_2/C_2H_2$ is 1.45 at the R2 inlet, and $H_2/C_2H_2$ is 1.4 at the interface a/b. Thus, the whole reaction is carried out at excess hydrogen. The ethylene selectivity is 42%, very close to that observed in current commercial operations, but the overall green oil selectivity is only 12%. For comparison, selectivities typically observed with Pd-based catalysts in tail-end converters are provided in Table 4.

TABLE 4

Conversion and Selectivities Theoretically Obtained from (a + b) Systems vs. b Systems Only

| | | | | | | Theoretical conversion and selectivities | | | |
|---|---|---|---|---|---|---|---|---|---|
| | $H_2$ | $C_2H_2$ | $C_2H_4$ | $C_2H_6$ | GO | $C_2H_2$ conv. | $C_2H_4$ selec. | $C_2H_6$ selec. | GO selec. |
| 1st reactor inlet (a) | 1.3 | 1 | | | | 77% | 42% | 46% | 12% |
| 1st reactor outlet (a) | 0.176 | 0.23 | 0.323 | 0.354 | 0.046 | | | | |
| 2nd reactor inlet (a or a') | 0.333 | 0.23 | | | | 77% | 42% | 46% | 12% |
| Interface (a or a')/b | 0.074 | 0.053 | 0.074 | 0.081 | 0.011 | | | | |
| Interface (a or a')/b | 0.074 | 0.053 | | | | 100% | 40% | 40% | 20% |
| 2nd reactor outlet (b) | 0 | 0 | 0.021 | 0.021 | 0.005 | | | | |
| Cumulative inlet | 1.457 | 1 | | | | 100% | 42% | 46% | 12% |
| Cumulative outlet | 0 | 0 | 0.419 | 0.457 | 0.062 | | | | |
| Conversion & selectivities (invention) | 100% | 100% | 42% | 46% | 12% | | | | |
| Conversion & selec. (commercial) | 100% | 100% | 45% | 25% | 30% | | | | |

A possible candidate for catalyst a for this second embodiment of this invention, namely 0.6% Pt, 2.4% Ru 1.2% Ag on $Al_2O_3$, has been described in Example I, Catalyst E above. The performance of this catalyst was measured in a single reactor setup under the following conditions: T(catalyst)=120° C., P=3000 psig, GHSV=4500 $H_2/C_2H_2$ feed ratio=1.3. The hydrocarbon feed contained 1.65 mole % acetylene, 70 mole % ethylene, and the balance nitrogen. Acetylene conversion and various selectivities are reported in Table 5.

TABLE 5

Conversion and Selectivities Obtained with Catalyst E

| Test # | Catalyst | $C_2H_2$ conv. | $C_2H_4$ selec. | $C_2H_6$ selec. | GO selec. |
|---|---|---|---|---|---|
| 8 | E | 76.7 | 41.2 | 46.6 | 12.2 |

As can be seen, the results actually obtained with this catalyst are very close to those described in Table 4.

In summary, the selective hydrogenation of acetylene generates a significant fraction of green oil due to two main reasons:

The use of Pd-based catalysts, which exhibit high green oil selectivity, and

The necessity to operate the reaction under "hydrogen lean" conditions, in order to avoid runaway and hydrogen breakthrough.

The process of the present invention uses a catalyst with low green oil selectivity, previously described above, and allows the reaction to proceed under relatively "hydrogen rich" conditions, thereby further minimizing green oil formation, while still avoiding reaction runaway and hydrogen breakthrough.

EXAMPLE IV

Additional evidence of the reduced green oil selectivity obtainable with the catalysts and method of the invention is presented in Table 6 below. In Example IVa, another inventive catalyst (made similarly to catalysts A through F, above) was placed first on the inlet side of the reactor, where the commercial palladium catalyst was placed second on the outlet side of the reactor. The commercial palladium catalyst was G-58C available from Süd Chemie Inc. Example IVc is provided for comparison and was run under conditions more like those used in a commercial process. Because Example IVa was intended to simulate the dual bed/dual catalyst process of this invention, the GHSV and hydrogen proportion were increased over the more typical, "commercial" conditions of comparative Example IVc, to be sure that the catalyst b or commercial catalyst was exposed to hydrogen. Example IVb is provided using no catalyst a under the same conditions as Example IVa for comparison. It may be seen that Example IVa simulating the instant invention gives a much lower green oil selectivity overall (17.15%), as compared with an identical process using no catalyst a, Example IVb (25.00%).

TABLE 6

Dual Catalyst/Dual Bed System

| Ex. | Catalyst description | GHSV | Catalyst Temp. ° C. | $H_2/C_2H_2$ | $C_2H_2$ conv. % | $H_2$ conv. % | $C_2H_4$ selec. % | $C_2H_6$ selec. % | GO selec. % |
|---|---|---|---|---|---|---|---|---|---|
| IVa | ½ Cat. A (0.06% Pt, 2.4% Ru, 2.4% Ag on Al2O3) + ½ commercial catalyst | 5600 | 120 | 1.3 | 84.04 | 92.82 | 25.14 | 57.71 | 17.15 |
| IVb | Commercial catalyst | 5600 | 120 | 1.3 | 94.22 | 100.00 | 20.95 | 54.04 | 25.00 |
| IVc | Commercial catalyst | 4500 | 100 | 1.1 | 89.13 | 100.00 | 36.28 | 36.40 | 27.32 |

In the foregoing specification, the invention has been described with reference to specific embodiments thereof, and has been demonstrated as effective in providing methods for directly and selectively hydrogenating acetylene and/or MAPD and/or BD using a dual bed/dual catalyst system. However, it will be evident that various modifications and changes can be made thereto without departing from the broader spirit or scope of the invention as set forth in the appended claims. Accordingly, the specification is to be regarded in an illustrative rather than a restrictive sense. For example, specific combinations of catalysts and/or reactants, other than those specifically tried, in other proportions or ratios or mixed in different ways, falling within the claimed parameters, but not specifically identified or tried in a particular method to selectively hydrogenate acetylene and/or MAPD and/or BD, are anticipated to be within the scope of this invention. Further, various combinations of reactants, catalyst systems, reaction conditions, and control techniques not explicitly described but nonetheless falling within the appended claims are understood to be included.

What is claimed is:

1. A selective hydrogenation method comprising:

contacting in the presence of hydrogen a feedstock comprising at least one unsaturated compound selected from the group consisting of acetylene, methyl acetylene, propadiene, 1,2-butadiene, 1,3-butadiene, dimethyl acetylene, ethyl acetylene and mixtures thereof with a low oligomers selectivity first hydrogenation catalyst in a first reaction zone to produce a first product stream; and contacting the first product stream in a second reaction zone having an inlet and an outlet, where the second reaction zone is at least partially filled with a second hydrogenation catalyst beginning from the outlet forward to produce a second product stream, where the second hydrogenation catalyst includes a metal selected from the group consisting of palladium, nickel and mixtures thereof wherein, the low oligomers selectivity first hydrogenation catalyst comprises a first constituent of at least one metal or metal-based component selected from the group consisting of nickel and platinum; and a second constituent of at least one metal or metal-based component selected from the elements consisting of Groups 1–10 of the Periodic Table of Elements (new IUPAC notation); and a third constituent of at least one metal or metal-based component selected from the elements of Groups 11–12 of the Periodic Table of Elements (new IUPAC notation); and a fourth constituent of at least one support and/or binder selected from the group consisting of amorphous inorganic oxides, crystalline inorganic oxides, silicon carbide, silicon nitride, boron nitride, and combinations thereof.

2. The method of claim 1 where the first and the second reaction zones are in one reactor, and the first and the second hydrogenation catalysts are packed in a stacked-bed configuration.

3. The method of claim 1 where the first and the second reaction zones are located in a series of separate reactors, and the first and the second hydrogenation catalysts occupy separate reactors.

4. The method of claim 1 where the first and the second reaction zones can employ a series of separate reactors wherein one of the reaction zones occupies at least one reactor and one of the reactors would be a stacked-bed reactor.

5. The method of claim 1 where additional hydrogen is added between reaction zones.

6. The method of claim 3 where additional hydrogen is added between reactors.

7. The method of claim 1 where the oligomers selectivity of the first hydrogenation catalyst in the first reaction zone is at least 30% lower than that of the second hydrogenation catalyst in the second reaction zone.

8. The method of claim 1 where the feedstock comprises acetylene and the acetylene conversion of the first hydrogenation catalyst is at least 50%.

9. The method of claim 1 where the feedstock comprises methyl acetylene and the methyl acetylene conversion of the first hydrogenation catalyst is at least 50%.

10. The method of claim 1 where the feedstock comprises propadiene and the propadiene conversion of the first hydrogenation catalyst is at least 50%.

11. The method of claim 1 where the feedstock comprises 1,2-butadiene and the 1,2-butadiene conversion of the first hydrogenation catalyst is at least 50%.

12. The method of claim 1 where the feedstock comprises 1,3-butadiene and the 1,3-butadiene conversion of the first hydrogenation catalyst is at least 50%.

13. The method of claim 1 where the feedstock comprises dimethyl acetylene and the dimethyl acetylene conversion of the first hydrogenation catalyst is at least 50%.

14. The method of claim 1 where the feedstock comprises ethyl acetylene and the ethyl acetylene conversion of the first hydrogenation catalyst is at least 50%.

15. The method of claim 1 where the first product stream comprises acetylene and the acetylene conversion of the second hydrogenation catalyst is at least 90%.

16. The method of claim 1 where the first product stream comprises methyl acetylene and the methyl acetylene conversion of the second hydrogenation catalyst is at least 90%.

17. The method of claim 1 where the first product stream comprises propadiene and the propadiene conversion of the second hydrogenation catalyst is at least 90%.

18. The method of claim 1 where the first product stream comprises 1,2-butadiene and the 1,2-butadiene conversion of the second hydrogenation catalyst is at least 90%.

19. The method of claim 1 where the first product stream comprises 1,3-butadiene and the 1,3-butadiene conversion of the second hydrogenation catalyst is at least 90%.

20. The method of claim 1 where the first product stream comprises dimethyl acetylene and the dimethyl acetylene conversion of the second hydrogenation catalyst is at least 90%.

21. The method of claim 1 where the first product stream comprises ethyl acetylene and the ethyl acetylene conversion of the second hydrogenation catalyst is at least 90%.

22. The method of claim 1 where the feedstock further comprises at least 50% ethylene and less than 5% acetylene.

23. The method of claim 1 where the feedstock further comprises at least 20% ethylene and less than 1% acetylene.

24. The method of claim 1 where the feedstock further comprises at least 80–85% propylene and less than 10% methyl acetylene and propadiene.

25. The method of claim 1 where the feedstock further comprises at least 90% butylene and greater than 0.2% butadiene.

26. The method of claim 1 where the hydrogenation conditions of the first reaction zone include an inlet temperature range of from 30 to 150° C., a pressure range of from 100 to 500 psig (690 to 3400 kPa), a GHSV of from 1000 to 10,000; and a $H_2/C_2H_2$ molar feed ratio from 0.5 to 20, and the hydrogenation conditions of the second reaction zone include an inlet temperature range of from 30 to 150° C., a pressure range of from 100 to 500 psig (690 to 3400 kPa) and a GHSV of from 1000 to 10,000 and a $H_2/C_2H_2$ molar feed ratio from 0.5 to 20.

27. The method of claim 1 where the hydrogenation conditions of the first reaction zone include an inlet temperature range of from 30 to 150° C., a pressure range of from 100 to 500 psig (690 to 3400 kPa) and a GHSV of from 5000 to 20,000; and a $H_2$ partial pressure from 25 psig to 175 psig (170 to 1200 kPa), and the hydrogenation conditions of the second reaction zone include an inlet temperature range of from 30 to 150° C., a pressure range of from 100 to 500 psig (690 to 3400 kPa) and a GHSV of from 5000 to 20,000, and a $H_2$ partial pressure from 25 psig to 175 psig (170 to 1200 kPa).

28. The method of claim 1 where hydrogenation is conducted in the liquid phase and the hydrogenation conditions of the first reaction zone include an inlet operating from 20 to 120° C., a pressure range from 150 psig to 600 psig (1000 to 4100 kPa), a LHSV from 0.1 to 100, and a $H_2/C_2H_2$ molar feed ratio from 0.5 to 20, and the hydrogenation conditions of the second reaction zone include an inlet operating from 20 to 120° C., a pressure range from 150 psig to 600 psig (1000 to 4100 kPa), a LHSV from 0.1 to 100, and a $H_2/C_2H_2$ molar feed ratio from 0.5 to 20.

29. The method of claim 1 where hydrogenation is conducted in the vapor phase and the hydrogenation conditions of the first reaction zone include an inlet operating temperature in the first reaction zone from 20 to 600° C., a pressure range from 150 psig to 600 psig (1000 to 4100 kPa), a GHSV from 100 to 20,000, and a $H_2/C_2H_2$ molar feed ratio from 0.5 to 20; and the hydrogenation conditions of the second reaction zone include an inlet operating temperature in the first reaction zone from 20 to 600° C., a pressure range from 150 psig to 600 psig (1000 to 4100 kPa), a GHSV from 100 to 20,000, and a $H_2/C_2H_2$ molar feed ratio from 0.5 to 20.

30. A selective hydrogenation method comprising:

contacting in the presence of hydrogen a feedstock comprising a compound selected from the group consisting of less than 5% acetylene and at least 50% ethylene thereof, where the contacting further comprises contacting the feedstock with a low oligomers selectivity first hydrogenation catalyst in a first reaction zone to produce a first product stream, where the oligomers selectivity of the first hydrogenation catalyst is at least 30% lower than the oligomers selectivity of the second hydrogenation catalyst in the second reaction zone, where the hydrogenation conditions of the first reaction zone include a temperature range of from 30 to 150° C., a pressure range of from 100 to 500 psig (690 to 3400 kPa), a GHSV of from 1000 to 10,000; and a $H_2/C_2H_2$ molar feed ratio from 0.5 to 20; and contacting the first product stream in a second reaction zone having an inlet and an outlet, where the second reaction zone is at least partially filled with a second hydrogenation catalyst beginning from the outlet forward to produce a second product stream, where the second hydrogenation catalyst includes a metal selected from the group consisting of palladium, nickel and mixtures thereof, and where the hydrogenation conditions of the second reactor zone include a temperature range of from 30 to 150° C., a pressure range of from 100 to 500 psig (690 to 3400 kPa) and a GHSV of from 1000 to 10,000, and a $H_2/C_2H_2$ molar feed ratio from 0.5 to 20.

31. The method of claim 30 where additional hydrogen is added between reaction zones.

32. The method of claim 30 where the first and the second reaction zones can employ series of separate reactors and where additional hydrogen is added between reactors.

33. A selective hydrogenation method comprising:

contacting in the presence of hydrogen a feedstock comprising a compound selected from the group consisting of less than 1% acetylene and at least 20% ethylene thereof, where the contacting further comprises contacting the feedstock with a non-palladium, low oligomers selectivity first hydrogenation catalyst in a first reaction zone to produce a first product stream, where the oligomers selectivity of the first hydrogenation catalyst is at least 30% lower than the oligomers selectivity of the second hydrogenation catalyst in the second reaction zone, where the hydrogenation conditions of the first reaction zone include a temperature range of from 30 to 150° C., a pressure range of from 100 to 500 psig (690 to 3400 kPa), a GHSV of from 5000 to 20,000; and a $H_2$ partial pressure from 25 psig to 175 psig (170 to 1200 kPa); and contacting the first product stream in a second reaction zone having an inlet and an outlet, where the second reaction zone is at least partially filled with a second hydrogenation catalyst beginning from the outlet forward to produce a second product stream, where the second hydrogenation catalyst includes a metal selected from the group consisting of palladium, nickel and mixtures thereof, and where the hydrogenation conditions of the second reaction zone include a temperature range of from 30 to 150° C., a pressure range of from 100 to 500 psig (690 to 3400 kPa), a GHSV of from 5000 to 20,000, and a $H_2$ partial pressure from 25 psig to 175 psig (170 to 1200 kPa).

34. The method of claim 33 where additional hydrogen is added between reaction zones.

35. The method of claim 33 where the first and the second reaction zones can employ series of separate reactors and where additional hydrogen is added between reactors.

36. A selective hydrogenation method comprising:

contacting in the presence of hydrogen a feedstock comprising a compound selected from the group consisting of at least 80–85% propylene and less than 10% methyl acetylene or propadiene thereof, where the contacting further comprises contacting the feedstock with a non-palladium, low oligomers selectivity first hydrogenation catalyst in a first reaction zone to produce a first product stream, where the oligomers selectivity of the first hydrogenation catalyst is at least 30% lower than the oligomers selectivity of the second hydrogenation catalyst in the second reaction zone, where the hydrogenation conditions of the first reaction zone can comprise include either (a) liquid phase operation, consisting of an inlet operating temperature from 20 to 100° C., a pressure range from 150 psig to 600 psig (1000 to 4100 kPa), a LHSV from 0.1 to 100, and a $H_2/C_2H_2$ molar feed ratio from 0.5 to 20 or (b) vapor phase operation, consisting zone include an inlet operating temperature from 20 to 600° C., a pressure range from 150 psig to 600 psig (1000 to 4100 kPa), a GHSV from 100 to 20,000, and a $H_2/C_2H_2$ molar feed ratio from 0.5 to 20; and contacting the first product stream in a second reaction zone having an inlet and an outlet, where the second reaction zone is at least partially filled with a second hydrogenation catalyst beginning from the outlet forward to produce a second product stream, where the second hydrogenation catalyst includes a metal selected from the group consisting of palladium, nickel and mixtures thereof, and where the hydrogenation conditions of the second reaction zone include either (a) liquid phase operation, consisting of an inlet operating temperature from 20 to 100° C., a pressure range from 150 psig to 600 psig (1000 to 4100 kPa), a LHSV from 0.1 to 100, and a $H_2/C_2H_2$ molar feed ratio from 0.5 to 20 or (b) vapor phase operation, consisting zone include an inlet operating temperature from 20 to 600° C., a pressure range from 150 psig to 600 psig (1000 to 4100 kPa), a GHSV from 100 to 20,000, and a $H_2/C_2H_2$ molar feed ratio from 0.5 to 20.

37. The method of claim 36 where additional hydrogen is added between reaction zones.

38. The method of claim 36 where the first and the second reaction zones can employ series of separate reactors and where additional hydrogen is added between reactors.

39. A selective hydrogenation method comprising:

contacting in the presence of hydrogen a feedstock comprising a compound selected from the group consisting of at least 90% butylene and greater than 0.2% butadiene thereof, where the contacting further comprises contacting the feedstock with a low oligomers selectivity first hydrogenation catalyst in a first reaction zone to produce a first product stream, where the oligomers selectivity of the first hydrogenation catalyst is at least 30% lower than the oligomers selectivity of the second hydrogenation catalyst in the second reaction zone, where the hydrogenation conditions of the first reaction zone include either (a) liquid phase operation, consisting of an inlet operating temperature from 20 to 100° C., a pressure range from 150 psig to 600 psig (1000 to 4100 psig), a LHSV from 0.1 to 100, and a $H_2/C_2H_2$ molar feed ratio from 0.5 to 20 or (b) vapor phase operation, consisting zone include an inlet operating temperature from 20 to 600° C., a pressure range from 150 psig to 600 psig (1000 to 4100 psig), a GHSV from 100 to 20,000, and a $H_2/C_2H_2$ molar feed ratio from 0.5 to 20; and contacting the first product stream in a second reaction zone having an inlet and an outlet, where the second reaction zone is at least partially filled with a second hydrogenation catalyst beginning from the outlet forward to produce a second product stream, where the second hydrogenation catalyst includes a metal selected from the group consisting of palladium, nickel and mixtures thereof, and where the hydrogenation conditions of the second reaction zone include either (a) liquid phase operation, consisting of an inlet operating temperature from 20 to 120° C., a pressure range from 200 psig to 600 psig (1400 to 4100 psig), a LHSV from 0.1 to 100, and a $H_2/C_2H_2$ molar feed ratio may range from 0.5 to 20, or (b) vapor phase operation, consisting zone include an inlet operating temperature from 20 to 600° C., a pressure range from 150 psig to 600 psig (1000 to 4100 psig), a GHSV from 100 to 20,000, and a $H_2/C_2H_2$ molar feed ratio from 0.5 to 20.

40. The method of claim 39 where additional hydrogen is added between reaction zones.

41. The method of claim 39 where the first and the second reaction zones can employ series of separate reactors and where additional hydrogen is added between reactors.

* * * * *